US007683589B2

(12) United States Patent
Temma et al.

(10) Patent No.: US 7,683,589 B2
(45) Date of Patent: Mar. 23, 2010

(54) REACTIVE POWER COMPENSATOR AND CONTROL DEVICE THEREFOR

(75) Inventors: Koji Temma, Tokyo (JP); Yoshiyuki Kono, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 287 days.

(21) Appl. No.: 11/984,755

(22) Filed: Nov. 21, 2007

(65) Prior Publication Data

US 2009/0001942 A1 Jan. 1, 2009

(30) Foreign Application Priority Data

Jun. 27, 2007 (JP) ..... 2007-168939

(51) Int. Cl.
*G05F 1/70* (2006.01)

(52) U.S. Cl. ..... 323/210

(58) Field of Classification Search ..... 323/205, 323/207–210

See application file for complete search history.

(56) References Cited

U.S. PATENT DOCUMENTS 4,755,738 A * 7/1988 Shimamura et al. ..... 323/210
4,857,821 A * 8/1989 Takeda ..... 323/210
2007/0279016 A1* 12/2007 Toki et al. ..... 323/209
2008/0157728 A1* 7/2008 Toki et al. ..... 323/210

FOREIGN PATENT DOCUMENTS

JP 04-021323 A 1/1992
JP 05-274049 A 10/1993
JP 10-268952 A 10/1998

* cited by examiner

*Primary Examiner*—Matthew V Nguyen
(74) *Attorney, Agent, or Firm*—Buchanan Ingersoll & Rooney PC

(57) ABSTRACT

A reactive power compensator includes a control block with a limiter and a primary delay-control block with a limiter that set, based on an output of a voltage sensor, reactive power produced by an SVC to a predetermined value. A reactive power controller sets the reactive power produced by the SVC to the predetermined value controls a voltage of a second bus to fall within a predetermined range. This is performed by adjusting an initial value of the reactive power that is output by the SVC, when a bus voltage of the second bus laid at a position apart from a first bus that is laid at a position near the SVC is deviated from a predetermined fixed range.

10 Claims, 11 Drawing Sheets

REACTIVE POWER COMPENSATOR AND CONTROL DEVICE THEREFOR

BACKGROUND OF THE INVENTION

1. Field of the Invention

The present invention relates to a reactive power compensator that generates reactive power to suppress voltage fluctuations of a power system, and a control device for controlling the reactive power compensator.

2. Description of the Related Art

Stabilizing control systems that can stabilize system voltage are known in the art. Japanese Patent Application Laid-Open No. H5-274049, for example, discloses a conventional system that uses a static var compensator (SVC) that controls a switching semiconductor element and can generate "leading" or a "lagging" reactive power instantly. In Japanese Patent Application Laid-Open No. H5-274049, a system that controls an operation of a generator that is operated in the system to an increasing direction is adopted. The system is controlled under a condition that reactive power supplied to the system by the SVC goes over a rating capacity of the SVC and exceeds a predetermined fixed value for a certain period of time. Accordingly, the system voltage set by the SVC is stabilized and maintained, thereby contributing to the stabilization of the system voltage.

Japanese Patent Application Laid-Open No. H10-268952 discloses another stabilizing control system. In the system of Japanese Patent Application Laid-Open No. H10-268952, in addition to the SVC, a capacitor, a reactor, and the like (hereinafter, collectively referred to as "phase modifying equipment") are used. The phase modifying equipment are connected to a power system interposing a switch therebetween. In Japanese Patent Application Laid-Open No. H10-268952, the system performs control so that a sum of the reactive power generated by the SVC and the reactive power generated by the phase modifying equipment becomes a required amount to suppress a voltage fluctuation. Accordingly, an adjusting range of the reactive power is enlarged, thereby contributing to the stabilization of the system voltage.

In the system that controls the voltage of the generator as indicated in Japanese Patent Application Laid-Open No. H5-274049, it is assumed that the SVC is located near the generator. This system enables to control the reactive power by closely controlling the generator, without closely controlling the SVC. Therefore, if the generator is located near the SVC, it is not too much to say that there is no need to improve the function of the SVC significantly.

When the SVC and the generator are located away from each other, the generator which is at a remote place as seen from the SVC is required to be controlled from a location of the SVC. This makes the control system complicated and increases the costs. Also, when controlling the generator, it is possible that other electrical transmission facilities are affected. Thus, it is not possible to control the reactive power alone.

Meanwhile, the control system disclosed in Japanese Patent Application Laid-Open No. H10-268952 can control the reactive power by utilizing characteristics of the SVC. However, when an electrical transmission facility at a remote place does not have phase modifying equipment, or even if it does have phase modifying equipment, when control elements of the phase modifying equipment are used up, a problem occurs that the voltage at the electrical transmission facility at the remote place cannot be preferentially controlled.

SUMMARY OF THE INVENTION

It is an object of the present invention to at least partially solve the problems in the conventional technology.

According to an aspect of the present invention, there is provided a reactive power compensator having a static var compensator that generates reactive power corresponding to a voltage fluctuation of a connection bus. The reactive power compensator suppresses voltage fluctuation of a first controlled bus laid near the static var compensator and suppresses voltage fluctuation of a second controlled bus laid at a distance from the static var compensator. The reactive power compensator includes a comparison-voltage producing unit that produces a comparison voltage following a first controlled voltage, which is a bus voltage of the first controlled bus, with a predetermined time delay characteristic and restricted to a predetermined range; a fluctuating-voltage producing unit that produces a fluctuating voltage being a differential output between the comparison voltage and the first controlled voltage; a reactive power controller that controls the reactive power generated by the static var compensator to be controlled corresponding to the fluctuating voltage with a time characteristic faster than the time delay characteristic of the comparison voltage; a reactive-power initial-value changing signal producing unit that produces a reactive-power initial-value changing signal that is a signal indicative of whether a second controlled voltage, which is a bus voltage of the second controlled bus, has deviated from a predetermined range follow with a predetermined time delay characteristic; and a reactive power adjusting unit that sets the reactive power produced by the static var compensator to a predetermined value, based on the reactive power produced by the static var compensator, the comparison voltage produced by the comparison-voltage producing unit, and a predetermined initial value, the reactive power adjusting unit controlling the second controlled voltage so as to fall within the predetermined range when the second controlled voltage has deviated from the predetermined range.

According to another aspect of the present invention, there is provided a reactive power compensator having a static var compensator that generates reactive power corresponding to a voltage fluctuation of a connection bus. The reactive power compensator suppresses voltage fluctuation of a first controlled bus laid near the static var compensator and suppresses voltage fluctuation of a second controlled bus laid at a distance from the static var compensator. The reactive power compensator includes a comparison-voltage producing unit that produces a comparison voltage following a first controlled voltage, which is a bus voltage of the first controlled bus, with a predetermined time delay characteristic and restricted to a predetermined range; a fluctuating-voltage producing unit that produces a fluctuating voltage being a differential output between the comparison voltage and the first controlled voltage; a reactive power controller that controls the reactive power generated by the static var compensator to be controlled corresponding to the fluctuating voltage with a time characteristic faster than the time delay characteristic of the comparison voltage; an output restriction value changing unit that changes an output restriction value of the comparison voltage produced by the comparison-voltage producing unit based on a second controlled voltage, which is a bus voltage of the second controlled bus; and a reactive power adjusting unit that sets the reactive power produced by the static var compensator to a predetermined value, based on the reactive power produced by the static var compensator and a predetermined initial value, the reactive power adjusting unit controlling the second controlled voltage so as to fall within the predetermined range when the second controlled voltage has deviated from the predetermined range.

According to still another aspect of the present invention, there is provided a reactive power compensator having a static var compensator that generates reactive power corresponding to a voltage fluctuation of a connection bus. The reactive power compensator suppresses voltage fluctuation of a first controlled bus laid near the static var compensator and suppresses voltage fluctuation of a second controlled bus laid at a distance from the static var compensator. The reactive power compensator includes a comparison-voltage producing unit that produces a comparison voltage following a first controlled voltage, which is a bus voltage of the first controlled bus, with a predetermined time delay characteristic and restricted to a predetermined range; a fluctuating-voltage producing unit that produces a fluctuating voltage being a differential output between the comparison voltage and the first controlled voltage; a reactive power controller that controls the reactive power generated by the static var compensator to be controlled corresponding to the fluctuating voltage with a time characteristic faster than the time delay characteristic of the comparison voltage; an output restriction value changing unit that changes an output restriction value of the comparison voltage produced by the comparison-voltage producing unit based on the reactive power produced by the static var compensator; and a reactive power adjusting unit that sets the reactive power produced by the static var compensator to a predetermined value, based on the reactive power produced by the static var compensator and a predetermined initial value, the reactive power adjusting unit controlling the reactive power so as to fall within the predetermined range, when the reactive power produced by the static var compensator has deviated from the predetermined range.

According to still another aspect of the present invention, there is provided a reactive power compensator having a static var compensator that generates reactive power corresponding to a voltage fluctuation of a connection bus. The reactive power compensator suppresses voltage fluctuation of a first controlled bus laid near the static var compensator and suppresses voltage fluctuation of a second controlled bus laid at a distance from the static var compensator. The reactive power compensator includes a comparison-voltage producing unit that produces a comparison voltage following a first controlled voltage, which is a bus voltage of the first controlled bus, with a predetermined time delay characteristic and restricted to a predetermined range; a fluctuating-voltage producing unit that produces a fluctuating voltage being a differential output between the comparison voltage and the first controlled voltage; a reactive power controller that controls the reactive power generated by the static var compensator to be controlled corresponding to the fluctuating voltage with a time characteristic faster than the time delay characteristic of the comparison voltage; a reactive-power initial-value changing signal producing unit that produces a signal for changing an initial value of the reactive power as a reactive-power initial-value changing signal based on the reactive power produced by the static var compensator; and a reactive power adjusting unit that sets the reactive power produced by the static var compensator to a predetermined value, based on the reactive power produced by the static var compensator and a predetermined initial value, the reactive power adjusting unit controlling the reactive power so as to fall within the predetermined range, when the reactive power produced by the static var compensator has deviated from the predetermined range.

According to still another aspect of the present invention, there is provided a reactive power control device that controls a static var compensator generating reactive power corresponding to a voltage fluctuation of a connection bus. The reactive power compensator suppresses voltage fluctuation of a first controlled bus laid near the static var compensator and suppresses voltage fluctuation of a second controlled bus laid at a distance from the static var compensator. The reactive power compensator includes a comparison-voltage producing unit that produces a comparison voltage following a first controlled voltage, which is a bus voltage of the first controlled bus, with a predetermined time delay characteristic and restricted to a predetermined range; a fluctuating-voltage producing unit that produces a fluctuating voltage being a differential output between the comparison voltage and the first controlled voltage; a reactive power controller that controls the reactive power generated by the static var compensator to be controlled corresponding to the fluctuating voltage by a time characteristic faster than the time delay characteristic of the comparison voltage; a reactive-power initial-value changing signal producing unit that produces a reactive-power initial-value changing signal that is a signal indicative of weather a second controlled voltage, which is a bus voltage of the second controlled bus, has deviated from a predetermined range follow with a predetermined time delay characteristic; and a reactive power adjusting unit that sets the reactive power produced by the static var compensator to a predetermined value, based on the reactive power produced by the static var compensator, the comparison voltage produced by the comparison-voltage producing unit, and a predetermined initial value, the reactive power adjusting unit controlling the second controlled voltage so as to fall within the predetermined range, when the second controlled voltage has deviated from the predetermined range.

According to still another aspect of the present invention, there is provided a reactive power control device that controls a static var compensator that generates reactive power corresponding to a voltage fluctuation of a connection bus. The reactive power compensator suppresses voltage fluctuation of a first controlled bus laid near the static var compensator and suppresses voltage fluctuation of a second controlled bus laid at a distance from the static var compensator. The reactive power control device includes a comparison-voltage producing unit that produces a comparison voltage following a first controlled voltage, which is a bus voltage of the first controlled bus, with a predetermined time delay characteristic and restricted to a predetermined range; a fluctuating-voltage producing unit that produces a fluctuating voltage being a differential output between the comparison voltage and the first controlled voltage; a reactive power controller that controls the reactive power generated by the static var compensator to be controlled corresponding to the fluctuating voltage by a time characteristic faster than the time delay characteristic of the comparison voltage; an output restriction value changing unit that changes an output restriction value of the comparison voltage produced by the comparison-voltage producing unit based on a second controlled voltage, which is a bus voltage of the second controlled bus; and a reactive power adjusting unit that sets the reactive power produced by the static var compensator to a predetermined value, based on the reactive power produced by the static var compensator and a predetermined initial value, the reactive power adjusting unit controlling the second controlled voltage so as to fall within the predetermined range, when the second controlled voltage has deviated from the predetermined range.

According to still another aspect of the present invention, there is provided a reactive power control device that controls a static var compensator that generates reactive power corresponding to a voltage fluctuation of a connection bus. The reactive power compensator suppresses voltage fluctuation of a first controlled bus laid near the static var compensator and suppresses voltage fluctuation of a second controlled bus laid at a distance from the static var compensator. The reactive power control device includes a comparison-voltage producing unit that produces a comparison voltage following a first controlled voltage, which is a bus voltage of the first controlled bus, with a predetermined time delay characteristic and restricted to a predetermined range; a fluctuating-voltage producing unit that produces a fluctuating voltage being a differential output between the comparison voltage and the first controlled voltage; a reactive power controller that controls the reactive power generated by the static var compensator to be controlled corresponding to the fluctuating voltage by a time characteristic faster than the time delay characteristic of the comparison voltage; an output restriction value changing unit that changes an output restriction value of the comparison voltage produced by the comparison-voltage producing unit based on the reactive power produced by the static var compensator; and a reactive power adjusting unit that sets the reactive power produced by the static var compensator to a predetermined value, based on the reactive power produced by the static var compensator and a predetermined initial value, the reactive power adjusting unit controlling the reactive power so as to fall within the predetermined range, when the reactive power produced by the static var compensator has deviated from the predetermined range.

According to still another aspect of the present invention, there is provided a reactive power control device that controls a static var compensator that generates reactive power corresponding to a voltage fluctuation of a connection bus. The reactive power compensator suppresses voltage fluctuation of a first controlled bus laid near the static var compensator and suppresses voltage fluctuation of a second controlled bus laid at a distance from the static var compensator. The reactive power control device includes a comparison-voltage producing unit that produces a comparison voltage following a first controlled voltage, which is a bus voltage of the first controlled bus, with a predetermined time delay characteristic and restricted to a predetermined range; a fluctuating-voltage producing unit that produces a fluctuating voltage being a differential output between the comparison voltage and the first controlled voltage; a reactive power controller that controls the reactive power generated by the static var compensator to be controlled corresponding to the fluctuating voltage by a time characteristic faster than the time delay characteristic of the comparison voltage; a reactive-power initial-value changing signal producing unit that produces a signal for changing an initial Value of the reactive power as a reactive-power initial-value changing signal based on the reactive power produced by the static var compensator; and a reactive power adjusting unit that sets the reactive power produced by the static var compensator to a predetermined value, based on the reactive power produced by the static var compensator and a predetermined initial value, the reactive power adjusting unit controlling the reactive power so as to fall within the predetermined range, when the reactive power produced by the static var compensator has deviated from the predetermined range.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be described in detail below with reference to the accompanying drawings. The present invention is not limited to the embodiments described below.

Figure 1:
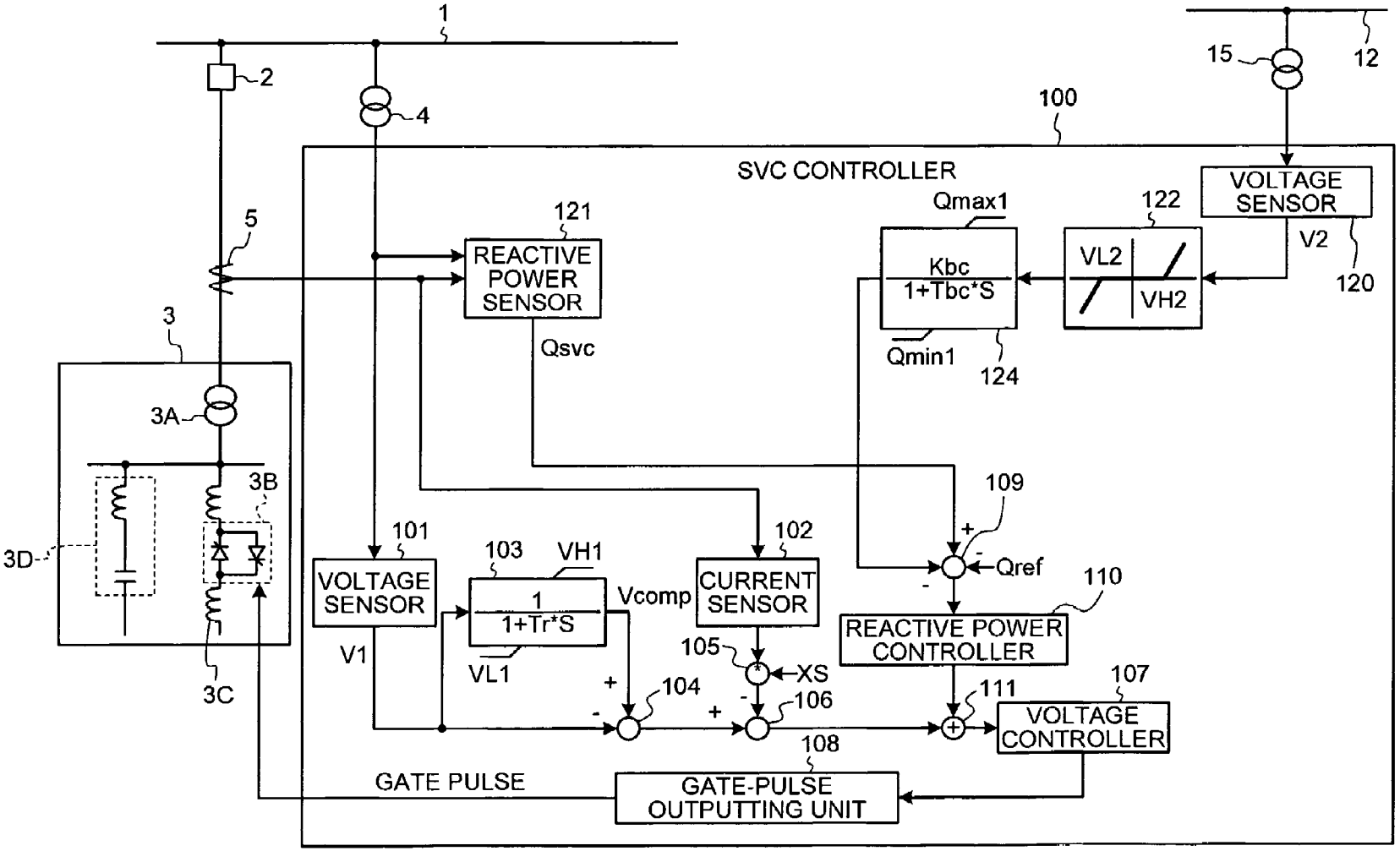
FIG. 1 is a schematic diagram of a reactive power compensator including a reactive power control device according to a first embodiment of the present invention.

FIG. 1 is a schematic diagram of a reactive power compensator including a reactive power control device according to a first embodiment of the present invention. The reactive power compensator includes an SVC 3 that is connected to a bus 1 via a circuit breaker 2, a potential transformer (PT) 4 that is connected to the bus 1 and measures the voltage of the bus 1, and another PT 15 that is connected to another bus 12 and measures the voltage of the bus 12. The reactive power compensator also includes a current transformer (CT) 5 that is interposed between the circuit breaker 2 and the SVC 3, and measures a current flowing to the SVC 3; and a SVC controller 100 that receives values detected by the PT 4, the PT 15, and the CT 5, and controls the voltages (reactive power) of the bus 1 and the bus 12 via the SVC 3. The bus 1 is a controlled bus that is disposed near the SVC 3. On the contrary, the bus 12 is a controlled bus that is located at a remote place, i.e., away from the SVC 3.

The SVC 3 includes a transformer 3A, a switching circuit 3B, a reactor 3C, and a filter 3D. The SVC 3 is a static var compensator that uses a thyristor controlled reactor (TCR).

The SVC 3 controls the magnitude and the phase of the reactive power generated by the reactor 3C by on/off controlling each thyristor included in the switching circuit 3B. The primary function of the filter 3D is to remove noise that occurs due to switching of the switching circuit 3B. However, because the filter 3D has an ability to generate reactive power at a leading side, the filter 3D also functions as a controlling unit for controlling the reactive power together with the reactor 3C. As a variant of the first embodiment, in addition to such a controlling unit, the SVC may be provided with a controlling unit that uses a thyristor switched capacitor (TSC).

The SVC controller 100 includes a voltage sensor 101 that receives voltage signals (instantaneous value) indicative of the bus voltage of the bus 1 and that is measured by the PT 4, and converts the signals and outputs them as the voltage signals (actual value) indicative of a control-target voltage. The SVC controller 100 includes a current sensor 102 that receives current signals indicative of the instantaneous value measured by the CT 5, and converts the signals and outputs them as the signals indicative of the actual value; and a primary delay-control block 103 with a limiter that receives the voltage signals and produces a comparison voltage following with a predetermined time delay characteristic and restricted to a predetermined range. Thus, the primary delay-control block 103 with a limiter is a comparison-voltage producing unit. The SVC controller 100 also includes a differentiator 104 that outputs a differential (fluctuating voltage) between an output of the primary delay-control block 103 with a limiter and an output of the voltage sensor 101. Thus, the differentiator 104 is a fluctuating-voltage producing unit. The SVC controller 100 also includes a slope reactance 105 to realize slope characteristics with which the voltage signals change at a predetermined rate with respect to a change of the reactive power generated by the SVC 3; and a differentiator 106 that outputs a differential calculated by deducting a product of current information output by the current sensor 102 and an impedance value XS of the slope reactance 105 (voltage drop at the slope reactance 105) from the fluctuating voltage.

The SVC controller 100 also includes a voltage sensor 120 that receives the voltage signals (instantaneous value) indicative of the bus voltage of the bus 12 measured by the PT 15, and converts the signals and outputs them as voltage signals (actual value) indicative of a control-target voltage; and a control block 122 with a limiter that receives voltage signals output from the voltage sensor 120 and produces predetermined control signals (voltage signals) when a bus voltage V2 of the bus 12 does not fall within a range from VH2 to VL2 (VH2>VL2). The SVC controller 100 also includes a primary delay-control block 124 with a limiter that receives the output of the control block 122 with a limiter and produces predetermined control signals (power signals) following with the predetermined time delay characteristic. Thus, the primary delay-control block 124 with a limiter is a comparison-power producing unit. The SVC controller 100 also includes a reactive power sensor 121 that receives the voltage signals from the PT 4 and the current signals from the CT 5, and measures reactive power Qsvc that is generated by the SVC 3. The SVC controller 100 also includes a differentiator 109 that outputs a differential (fluctuating power) between an output of the reactive power sensor 121 and each output of a predetermined value Qref and the primary delay-control block 124 with a limiter; and a reactive power controller 110 that receives the output of the differentiator 109 and controls the reactive power Qsvc generated by the SVC 3 so as to match with the predetermined value Qref; an adder 111 that adds an output of the reactive power controller 110 and an output of the differentiator 104; and a voltage controller 107 that receives the output of the adder 111 and outputs a voltage target value with PI characteristics.

The SVC controller 100 also includes a gate-pulse outputting unit 108 that receives the voltage target value, produces gate pulse signals, and outputs the signals to the switching circuit 3B of the SVC 3. The gate pulse signals are such that a reactive power is generated that enables the voltages of the bus 1 and the bus 12 to converge to the voltage target value.

A time constant Tr that determines the time delay characteristics of the primary delay-control block 103 with a limiter is sufficiently larger than a time constant that determines control characteristics of the SVC 3. Also, a time constant Tbc that determines the time delay characteristics of the primary delay-control block 124 with a limiter is larger than the time constant Tr of the primary delay-control block 103 with a limiter. A comparison voltage Vcomp that is output by the primary delay-control block 103 with a limiter is restricted to a control range of an output voltage of the bus 1, which is equal to or more than VL1 and equal to or less than VH1 (VH1>VL1). The control signals (power signals) output by the primary delay-control block 124 with a limiter are restricted to a range equal to or more than Qmin1 and equal to or less than Qmax1 (Qmax1>Qmin1), which is the control range of an output power of the SVC 3.

The operation of the reactive power compensator will now be explained. For better understanding of the first embodiment, the configuration shown in FIG. 1 has been modified in the following manner into three configurations, and an operation of each configuration is explained below.

(1) First Configuration

The first configuration is the one that does not include, in the configuration shown in FIG. 1, the reactive power sensor 121, the differentiator 109, and the reactive power controller 110.

(2) Second Configuration

The second configuration is the one that includes, in the configuration shown in FIG. 1, the reactive power sensor 121, the differentiator 109, and the reactive power controller 110, and only the outputs of the reactive power sensor 121 and the predetermined value Qref are input to the differentiator 109.

(3) Third Configuration

The third configuration is the one that includes, in the configuration shown in FIG. 1, the reactive power sensor 121, the differentiator 109, the reactive power controller 110, the voltage sensor 120, the control block 122 with a limiter, and the primary delay-control block 124 with a limiter. Output of each of the reactive power sensor 121, the predetermined value Qref, and the primary delay-control block 124 are input to the differentiator 109. In other words, the third configuration is the one that is shown in FIG. 1.

In the second configuration, the differentiator 109 and the reactive power controller 110 form a reactive power adjusting unit. In the third configuration, the control block 122 with a limiter and the primary delay-control block 124 with a limiter form a reactive-power initial-value changing signal producing unit (primary reactive-power initial-value changing signal producing unit). The reactive-power initial-value changing signal producing unit produces control signals to change a reactive power initial value.

Figure 2:
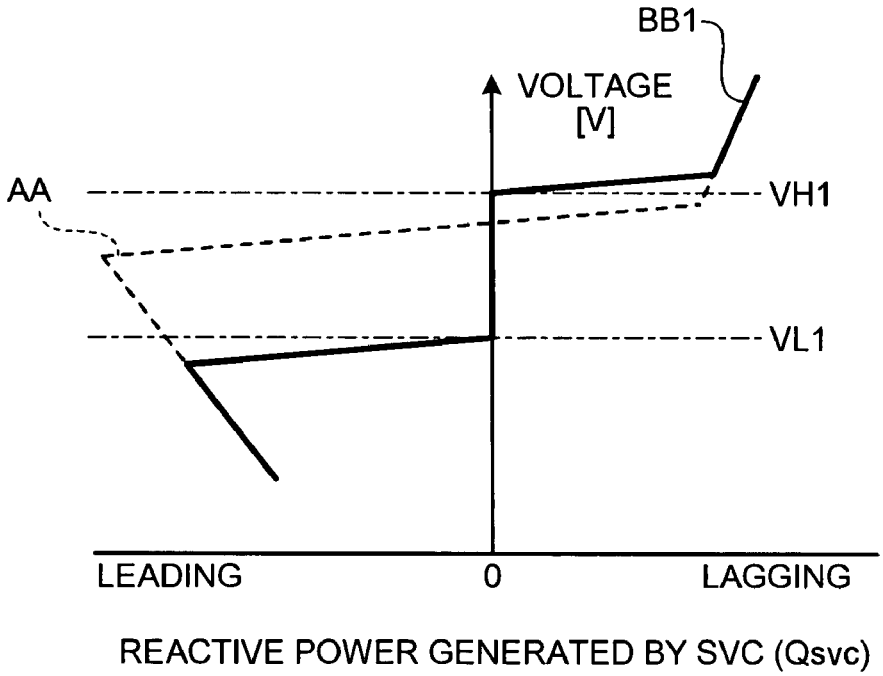
FIG. 2 is a schematic diagram for explaining a relationship between bus voltage and reactive power generated by an SVC shown in FIG. 1.
Figure 3:
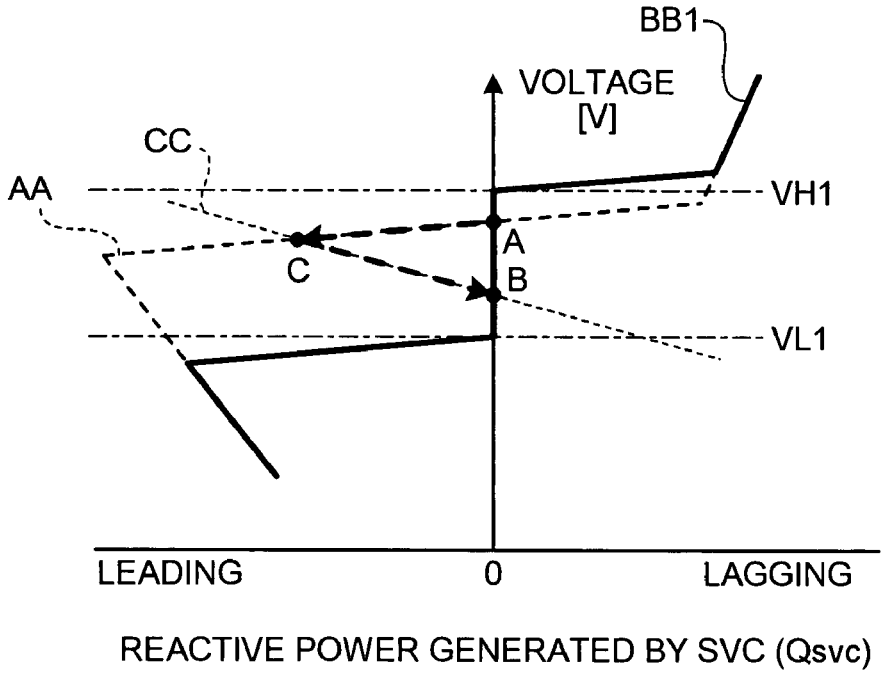
FIG. 3 is a schematic diagram for explaining an operation of a first configuration.

The operation of the first configuration will be described with reference to FIGS. 1 to 3. FIG. 2 is a schematic diagram for explaining a relationship between bus voltage and reactive power generated by the SVC when the reactive power compensator according to the first embodiment of the present invention operates. FIG. 3 is a schematic diagram for explaining an operation of the first configuration when a fluctuation of the bus voltage V1 is within a predetermined range. It is assumed that a state of a power system does not change until a disturbance of the power system that brings a voltage fluctuation occurs, and the state of the power system does not change after the disturbance.

The broken line in FIG. 2 indicates a dynamic characteristic line AA. In a range in which the magnitude of the absolute value of Qsvc is equal to or less than a predetermined value, the voltage V1 of the bus 1 changes with an inclination determined by the impedance value XS of the slope reactance 105, with respect to a change of the reactive power Qsvc. The reactive power Qsvc is generated by the SVC 3. The dynamic characteristic line AA is similar to the voltage that the conventional SVC has, that is, reactive power characteristics (hereinafter, referred to as "slope characteristics"). While only one dynamic characteristic line is shown in FIG. 2, when Qsvc=0, an infinite number of dynamic characteristic lines that pass through the range of VL1=V1=VH1 exist in parallel with each other.

The bold solid line in FIG. 2 indicates a static characteristic line (steady-state characteristic line) BB1. In a range in which the bus voltage V1 is equal to or more than VH1, or equal to or less than VL1, and the magnitude of the absolute value of Qsvc is equal to or less than the predetermined value, the static characteristic line BB1 also has the slope characteristics. When the bus voltage V1 is within a range from VL1 to VH1, as hereinafter described, the SVC controller 100 operates to become Qsvc=0.

The operation of the first configuration when fluctuation of bus voltage V1 is within a predetermined range will be described now. That is, a change of an operating point when the disturbance occurs to the power system, while the fluctuation of the bus voltage V1 is within a predetermined range will now be described. In FIG. 3, an operating point A is in a state before the disturbance occurs to the power system. At the operating point A, a bus voltage VA at that state is VL1<VA<VH1, as well as Qsvc=0. Suppose that at this moment the disturbance occurs to the power system at the operating point A, and drops the voltage of the bus 1. The level of the voltage drop at this time should be the level that the operating point A changes to an operating point B shown in FIG. 3, when the SVC 3 does not operate. A bus voltage VB at the operating point B should be VL1<VB<VH1. The time constant of the rate of change of the voltage drop is nearly equal to the time constant of the control characteristics of the SVC 3, and it should be sufficiently smaller than the time constant Tr of the time delay characteristics of the primary delay-control block 103 with a limiter. Therefore, the comparison voltage Vcomp that is an output of the primary delay-control block 103 with a limiter does not change immediately by following the disturbance of the power system. The SVC 3 performs an operation similar to that when the reactive power control device according to the first embodiment is not employed.

By operating the SVC 3, the bus voltage V1 changes so as to be on the dynamic characteristic line AA that indicates the slope characteristics. As a characteristic of the power system side, a relationship indicated by a system characteristic line CC shown in FIG. 3 should be established, between the bus voltage V1 and the reactive power Qsvc that is generated by the SVC 3. Therefore, when the SVC 3 is operated, the operating point changes to a point C that is an intersection point of the dynamic characteristic line AA and the system characteristic line CC.

The comparison voltage Vcomp approaches to the bus voltage V1 by the time constant Tr. The comparison voltage Vcomp is the voltage at Qsvc=0 on the dynamic characteristic line. When the comparison voltage Vcomp drops, the dynamic characteristic line changes to a further lower side, and the bus voltage V1 also drops. The relationship shown by the system characteristic line CC should be established as it is, at a state with no change to the power system side. Therefore, the operating point moves towards the point B on the system characteristic line CC. When the comparison voltage Vcomp matches with the bus voltage V1, the fluctuating voltage between the comparison voltage Vcomp and the reactive power Qsvc that is generated by the SVC 3 becomes zero, thereby settling to the state at the operating point B. Accordingly, the operating point with respect to the voltage drop changes in sequence from A to C and then to B. The change from A to C is fast by the time constant of the dynamic characteristics of the SVC 3, and the change from C to B is slow by the time constant Tr of the primary delay-control block 103 with a limiter. In the change from A to C, although Qsvc changes sharply, the bus voltage V1 does not change much. Therefore, the bus voltage V1 changes slowly from VA to VB. At the operating point B, which is in the steady state, it is Qsvc=0. Therefore, the SVC 3 is waiting at the center of its movable range, and even if a new and sharp voltage fluctuation occurs at either an increasing side or a decreasing side, the sharp voltage fluctuation can be suppressed.

Figure 4:
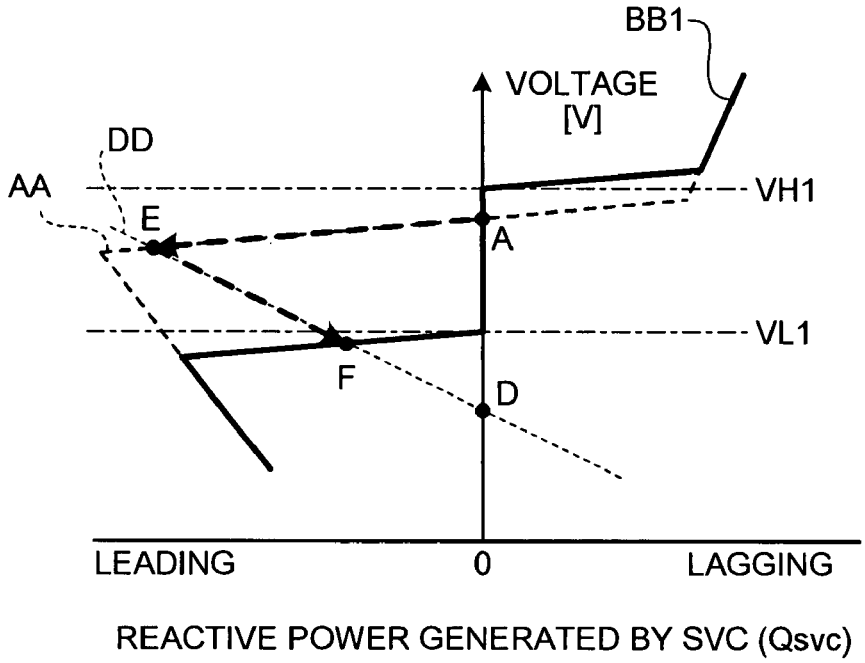
FIG. 4 is a schematic diagram for explaining another operation of the first configuration.

The operation of the first configuration when fluctuation of bus voltage V1 deviates from the predetermined range will be described now. That is, a change of the operating point when the disturbance occurs to the power system, when the fluctuation of the bus voltage V1 deviates from a predetermined range will now be described with reference to FIG. 4. FIG. 4 is a schematic diagram for explaining an operation of the first configuration, when a fluctuation of the bus voltage V1 deviates from a predetermined range. The amount of the voltage drop to be assumed shall be equivalent to the level that the operating point A changes to an operating point D shown in FIG. 4, when the SVC 3 does not operate. A bus voltage VD at the operating point D is VD<VL1. The rate of change of the voltage drop is similar to that shown in FIG. 3.

In FIG. 4, the operating point just after the occurrence of the voltage drop changes to an operating point E. The operating point E has the absolute value that the reactive power Qsvc that is generated by the SVC 3 is larger than that shown in FIG. 3. The comparison voltage Vcomp approaches to the bus voltage V1 by the time constant Tr. As a result, the operating point E moves slowly towards the operating point D on a system characteristic line DD that goes through the operating point E. Meanwhile, because the comparison voltage Vcomp is restricted to a range of VL1=Vcomp=VH1, it settles to an operating point of Vcomp=VL1. That is, an intersection point of the system characteristic line DD and the static characteristic line BB1. At an operating point F, Qsvc is not zero but smaller than the value at the operating point E. Therefore, the level of the voltage fluctuation that can be suppressed at the SVC 3, when the sharp voltage drop occurs, becomes larger than that at the operating point E.

As such, according to the first configuration, the SVC 3 operates to a sharp change of the bus voltage as in the related art, thereby enabling to ease the steep voltage fluctuations and enabling to bring the reactive power that is output by the SVC 3 to approach zero at a steady time. Therefore, even at the state that the sharp voltage fluctuation occurs, due to the occurrence of the disturbance and the like to the power system, the SVC 3 is operable at any time and enables to suppress the steep voltage fluctuations. An example when the voltage has dropped was explained. However, a similar operation can be performed, when the voltage shoots. In the above explanation, the primary delay-control block 103 was used for the controller to produce the comparison voltage. However, it is apparent that a delay control block equal to or more than the second delay control block can be used.

Figure 5:
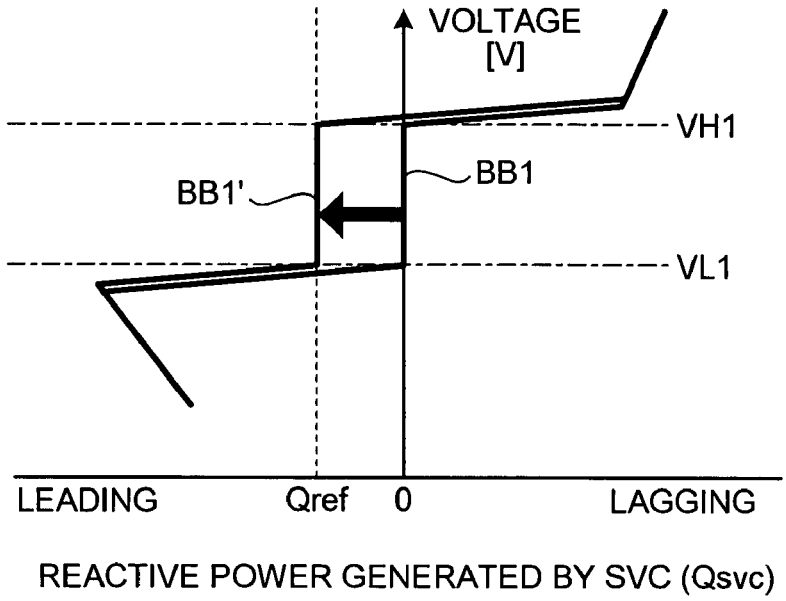
FIG. 5 is a schematic diagram for explaining an operation of a second configuration.

The operation of the second configuration will now be described with reference to FIGS. 1 and 5. FIG. 5 is a schematic diagram for explaining the operation of the second configuration.

The static characteristic line BB1 in FIG. 5 is equivalent to the line BB1 shown in FIG. 2. Contrary to the static characteristic line BB1, for a static characteristic line BB1', when the bus voltage V1 is within the range from VH1 to VL1, Qsvc does not become zero but it depends on Qref. This is because the reactive power Qsvc that is generated by the SVC 3 is controlled so as to match with Qref by the SVC controller 100, at a state when the fluctuating voltage becomes zero. The fluctuating voltage is an output of the differentiator 104. In other words, the reactive power compensator according to the first configuration brings the reactive power that is generated by the SVC 3, to approach zero with the time passage. However, in the second configuration, the reactive power that is generated by the SVC 3, is controlled so as to approach the predetermined value Qref as the time passes.

As such, according to the second configuration, the steep voltage fluctuations can be suppressed by the SVC 3, moreover the reactive power that is generated by the SVC 3 can be adjusted to an appropriate value at the steady time. Therefore, even if sharp voltage fluctuations occur due to the occurrence of the disturbance and the like to the power system, the SVC 3 is operable within an appropriate range corresponding to an installation position of the SVC 3. As a result, steep voltage fluctuations can be suppressed from occurring at any time.

The value Qref that is input to the differentiator 109 can be set in various manner. For example, Qref may be any predetermined value, or the SVC controller 100 can be configured to receive Qref from a load dispatching center, a control center, or the like. Moreover, Qref can be a fixed value at any time, or can be a variable value that is varied based on the state of the power system. For example, if the SVC 3 is disposed at a position where voltage tends to easily drop, then it is preferable to set Qref to a lagging reactive power of suitable magnitude. In other words, a leading reactive power that the SVC 3 can generate instantly is preferably set so as to become large, to prevent the sharp drop of the voltage. On the contrary, if the SVC 3 is disposed at a position where the voltage tends to easily rise, the lagging reactive power that the SVC 3 can generate instantly is preferably set so as to become large, to prevent the sharp increase of the voltage.

Figure 6:
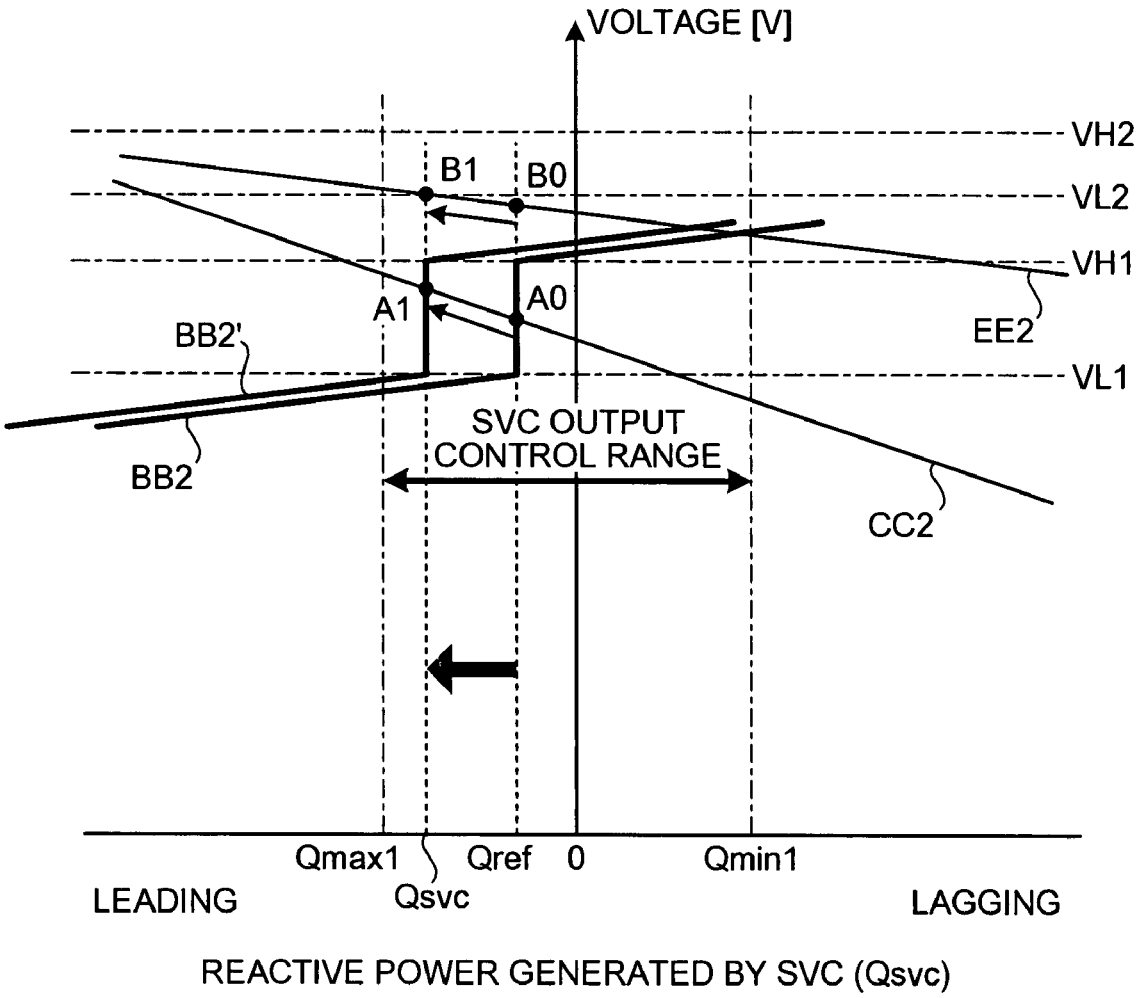
FIG. 6 is a schematic diagram for explaining an operation of a third configuration.

The operation of the third configuration will now be described with reference to FIGS. 1 and 6. FIG. 6 is a schematic diagram for explaining the operation of the third configuration. A static characteristic line BB2 in FIG. 6 is equivalent to the line BB1 shown in FIG. 5, and as an initial condition, it shall be controlled by Qsvc=Qref. The output voltage of the bus 12 is controlled by equal to or more than VL2, and equal to or less than VH2.

First, as shown in FIG. 6, the operating point of the bus 1 is controlled by an intersection point (operating point A0) of the static characteristic line BB2 of the bus 1 and a system characteristic line CC2. The operating point of the bus 12 is controlled by an intersection point (operating point B0) of a system characteristic line EE2 of the bus 12 and a straight line of Qsvc=Qref. At this state, when the control signals of the primary delay-control block 124 with a limiter are input to the differentiator 109, the following control is performed:

(1) At an initial state when the operating point on the system characteristics of the bus 12 is at B0, it is V2<VL2. Therefore, an integral treatment (in actual, first delay integral treatment) of a voltage deviation $\epsilon$=(V2−VL2) is performed at the primary delay-control block 124 with a limiter. By shifting Qref to a leading phase side to increase an output of the SVC 3, the operating point on the system characteristics of the bus 1 moves from A0 (static characteristic line BB2) to A1 (static characteristic line BB2').

(2) As a result, the operating point on the system characteristics of the bus 12 moves from B0 towards B1.

(3) At the operating point A1, the voltage deviation $\epsilon$=(V2−VL2)=0, and a further Qref shift will not be performed. This is because the voltage V2 of the bus 12 reaches a lower limit value (VL2) of the control voltage of the bus 12, at the operating point B1 on the system characteristics of the bus 12. As a result, the steady state is reached at the operating point A1 on the system characteristics of the bus 12.

(4) Thereafter, a load connected to the bus 12 is reduced, and when the voltage of the bus 12 rises, it becomes VL2<V2<VH2. Accordingly, an output of the control system that links the voltage sensor 120, the control block 122 with a limiter, and the primary delay-control block 124 with a limiter will be reset slowly. A shift amount of Qref is reduced within a range that satisfies V2=VL2. In time, it will return to the steady state at Qsvc=Qref.

An example is explained above in which the bus voltage V2 of an electrical transmission facility at the remote place falls below a default. However, a similar operation can be performed, when the bus voltage V2 exceeds the default.

As described above, in the reactive power compensator according to the first embodiment, when the bus voltage V2 of the electrical transmission facility at the remote place deviates from the default, the bus voltage V2 can be controlled so as to fall within a stipulated range (VL2=V2=VH2). This is enabled by adjusting the initial value (Qref) of the reactive power Qsvc that is generated by the SVC 3. Therefore, when an electrical transmission facility at a remote place does not have phase modifying equipment, or even if it does have phase modifying equipment, when control elements of the phase modifying equipment are used up, the voltage at the electrical transmission facility at the remote place can be preferentially controlled.

In the reactive power compensator according to the first embodiment, when the voltage V2 of the bus 12 is to be controlled, the reactive power Qsvc that is generated by the SVC 3 is within an SVC output control range. In other words, in the reactive power compensator according to the first embodiment, a control to bring the reactive power Qsvc that is generated by the SVC 3 to fall within the SVC output control range is given preference to the control of the voltage V2 of the bus 12. Meanwhile, a reactive power compensator according to the second embodiment preferentially controls the voltage V2 of the bus 12, by lifting a restriction that the reactive power Qsvc that is generated by the SVC 3 is within the SVC output control range. The configuration of the reactive power compensator according to the second embodiment is the same or equal to the configuration of the first embodiment shown in FIG. 1.

Figure 7:
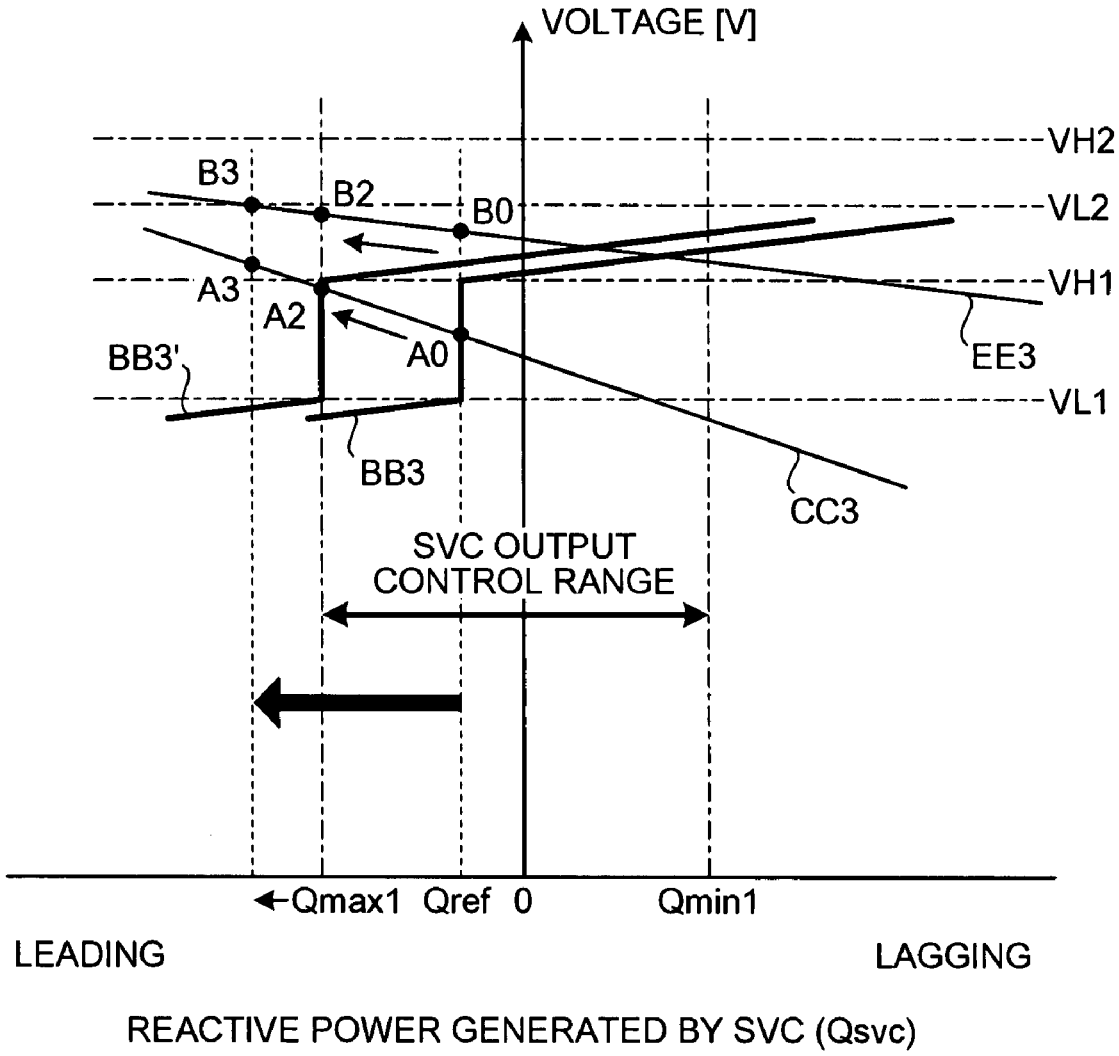
FIG. 7 is a schematic diagram for explaining an operation of a reactive power compensator according to a second embodiment of the present invention.

The operation of the reactive power compensator according to the second embodiment will now be described with reference to FIGS. 1 and 7. FIG. 7 is a schematic diagram for explaining the operation of the reactive power compensator according to the second embodiment.

As shown in FIG. 7, the operating point of the bus 1 is on the straight line of Qsvc=Qref, and controlled by the intersection point (operating point A0) of a static characteristic line BB3 of the bus 1 and a system characteristic line CC3. The operating point of the bus 12 is controlled by the intersection point (operating point B0) of a system characteristic line EE3 of the bus 12 and the straight line of Qsvc=Qref. At this state, when the control signals of the primary delay-control block 124 with a limiter are input to the differentiator 109, the following control is performed:

(1) At an initial state when the operating point on the system characteristics of the bus 12 is at B0, it is V2<VL2. Therefore, the integral treatment of the voltage deviation $\epsilon$=(V2−VL2) is performed at the primary delay-control block 124 with a limiter. By shifting Qref to the leading phase side to increase the output of the SVC 3, the operating point on the system characteristics of the bus 1 moves from A0 (static characteristic line BB3) towards A2 (static characteristic line BB3').

(2) As a result, the operating point on the system characteristics of the bus 12 moves from B0 towards B2.

(3) At the operating point B2, the output of the SVC 3 reaches Qsvc=Qmax1. However, the voltage V2 of the bus 12 has not reached the lower limit value (VL2) of the control voltage of the bus 12.

(4) To perform a control to further increase the voltage V2 of the bus 12, an upper limit value (Qmax1) of the primary delay-control block 124 with a limiter is increased (that is, shift to the leading phase side). Because the restriction of the upper limit value (Qmax1) at the primary delay-control block 124 with a limiter is lifted at this time, the reactive power Qsvc at the leading side that is generated by the SVC 3 can be made equal to or more than Qmax1. As a result, the operating point on the system characteristic line CC3 of the bus 1 moves further to A3 (static characteristic line BB3). The operating point on the system characteristic line EE3 of the bus 12 reaches to the steady state by moving to B3 point, which becomes V2=VL2.

(5) Thereafter, the load connected to the bus 12 is reduced, and when the voltage of the bus 12 rises, it becomes VL2<V2<VH2. Therefore, a control in a direction returning to an original value is performed within a range that the upper limit value (Qmax1) being shifted temporarily satisfies VL2<V2<VH2.

An example is explained above in which the bus voltage V2 of the electrical transmission facility at the remote place falls below the default. However, a similar operation can be performed when the bus voltage V2 exceeds the default. This is enabled by forming a control system that decreases (that is, shift to a lagging phase side) the lower limit value (Qmin1) of the primary delay-control block 124 with a limiter, based on the spirit and scope of the reactive power compensator according to the embodiment.

As described above, in the reactive power compensator according to the first embodiment, when the bus voltage V2 of the electrical transmission facility at the remote place deviates from the default, the bus voltage V2 can be controlled so as to fall within the stipulated range (VL2=V2=VH2). This is performed by adjusting the upper limit value (Qmax1) or the lower limit value (Qmin1) at the primary delay-control block 124 with a limiter. Therefore, when an electrical transmission facility at a remote place does not have phase modifying equipment, or even if it does have phase modifying equipment, when the control elements of the phase modifying equipment are used up, the voltage at the electrical transmission facility at the remote place can be preferentially controlled.

Figure 8:
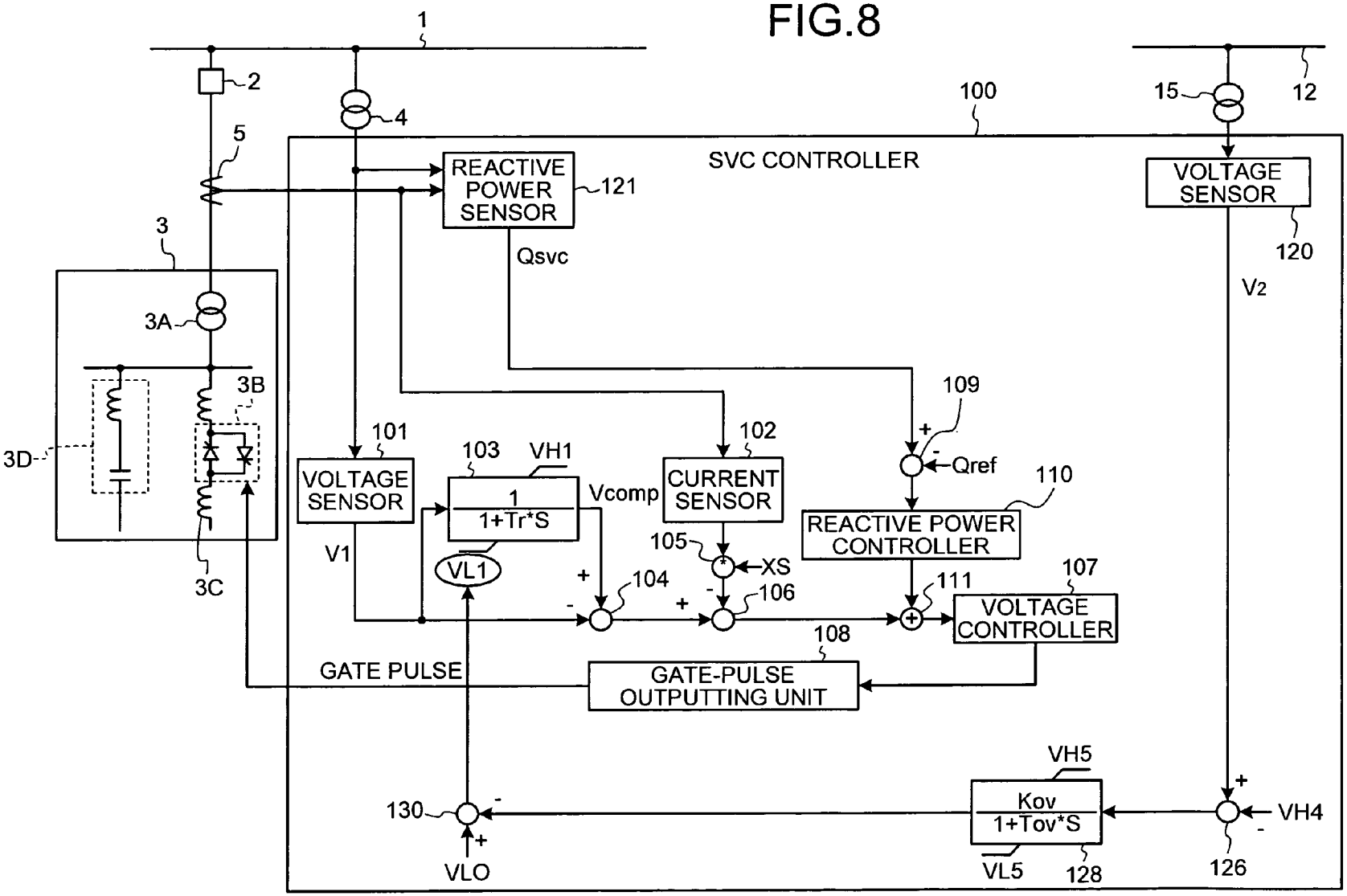
FIG. 8 is a schematic diagram of a reactive power compensator including a reactive power control device according to a third embodiment of the present invention.

FIG. 8 is a schematic diagram of a reactive power compensator including a reactive power controller according to a third embodiment of the present invention. The reactive power compensator shown in FIG. 8 does not have the control block 122 with a limiter and the primary delay-control block 124 with a limiter of FIG. 1. Meanwhile, the reactive power compensator includes a differentiator 126 that outputs a differential between an output of the voltage sensor 120 and a predetermined voltage (VH4), and a primary delay-control block 128 with a limiter. The primary delay-control block 128 with a limiter receives the output of the differentiator 126 and produces predetermined control signals (voltage signals) following with a predetermined time delay characteristic. The reactive power compensator also includes a differentiator 130 that receives the output of the primary delay-control block 128 with a limiter, and outputs a differential with respect to a predetermined voltage (VL0). The differentiator 126, the primary delay-control block 128 with a limiter, and the differentiator 130 form an output restriction value changing unit (primary output-restriction-value changing unit). The output restriction value changing unit changes an output restriction value of the primary delay-control block 103 with a limiter that forms a comparison-voltage producing unit. The other configurations are similar to those shown in FIG. 1, and the same elements are denoted by the same reference numerals and the description thereof will be omitted.

Figure 9:
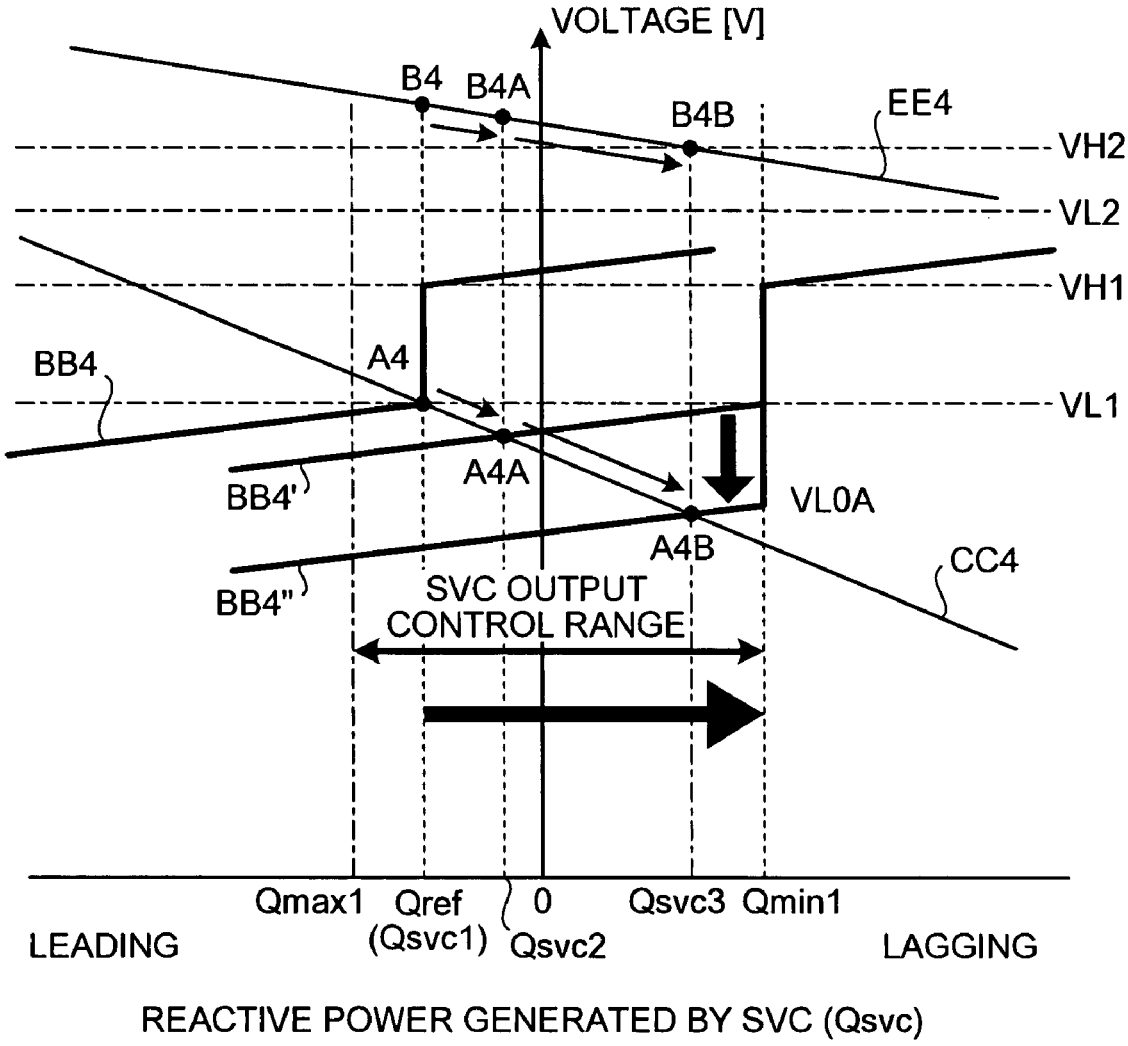
FIG. 9 is a schematic diagram for explaining an operation of the reactive power compensator shown in FIG. 8.

The operation of the reactive power compensator according to the third embodiment will now be described with reference to FIGS. 8 and 9. FIG. 9 is a schematic diagram for explaining the operation of the reactive power compensator according to the third embodiment.

As shown in FIG. 9, the operating point of the bus 1 is on the straight line of Qsvc=Qref, and controlled by an intersection point (operating point A4) of a static characteristic line BB4 of the bus 1 and a system characteristic line CC4. The operating point of the bus 12 is controlled by an intersection point (operating point B4) of a system characteristic line EE4 of the bus 12 and the straight line of Qsvc=Qref. At this state, when the control signals that control the lower limit value (VL1) of the primary delay-control block 103 with a limiter are input, the following control is performed:

(1) At an initial state when the operating point on the system characteristics of the bus 12 is at B4, it is V2>VH2. Therefore, the integral treatment of the voltage deviation $\epsilon$=(V2−VH2) is performed. By increasing the lagging phase output of the SVC 3 by shifting Qref to the lagging phase side, the operating point on the system characteristic of the bus 1 moves from A4 (static characteristic line BB4) towards A4A (static characteristic line BB4'). As shown in FIG. 9, a position of a dead band (position of a portion parallel to a longitudinal axis at the static characteristic line) is shifted to Qmin1. However, in the configuration of the control system up to the second embodiment, the SVC 3 maintains an output (Qsvc 2) that corresponds to the operating point A4A, because the voltage of the bus 1 is controlled so as not to fall below the lower limit value (VL2).

(2) As a result, the operating point on the system characteristic of the bus 12 moves from B4 towards B4A. However, at this operating point, the voltage V2 of the bus 12 still exceeds the upper limit value (VH2) at the control voltage of the bus 12.

(3) To perform a control to further decrease the voltage V2 of the bus 12, a control to decrease the lower limit value (VL1) of the primary delay-control block 103 with a limiter is performed, based on the output of the differentiator 130. That is, a new lower limit value (VL0A) is set by shifting the lower limit value (VL1) at the primary delay-control block 124 with a limiter to a lower direction, with an output of the differentiator 130. By this control, the operating point A4A on the system characteristic line CC4 of the bus 1 moves further to A4B (static characteristic line BB4"). The operating point B4A on the system characteristic line EE4 of the bus 12 reaches the steady state, by moving to B4B where V2=VH2.

(4) Thereafter, the load connected to the bus 12 is increased. When the voltage of the bus 12 drops, it becomes VL2<V2<VH2, thereby performing a control to reset slowly.

An example is explained above in which the bus voltage V2 of the electrical transmission facility at the remote place exceeds the default. However, similar operation can be performed when the bus voltage V2 falls below the default. This is enabled by forming a control system that increases the upper limit value (VH1) of the primary delay-control block 103 with a limiter, based on the spirit and scope of the reactive power compensator according to the third embodiment.

As described above, in the reactive power compensator according to the third embodiment, when the bus voltage V2 of the electrical transmission facility at the remote place deviates from the default, the bus voltage V2 can be controlled so as to fall within the stipulated range (VL2=V2=VH2). This is enabled by adjusting the lower limit value (VL1) or the upper limit value (VH1) of the primary delay-control block 103 with a limiter. Therefore, when an electrical transmission facility at a remote place does not have phase modifying equipment, or even if it does have phase modifying equipment, when the control elements of the phase modifying equipment are used up, the voltage at the electrical transmission facility at the remote place can be preferentially controlled.

Figure 10:
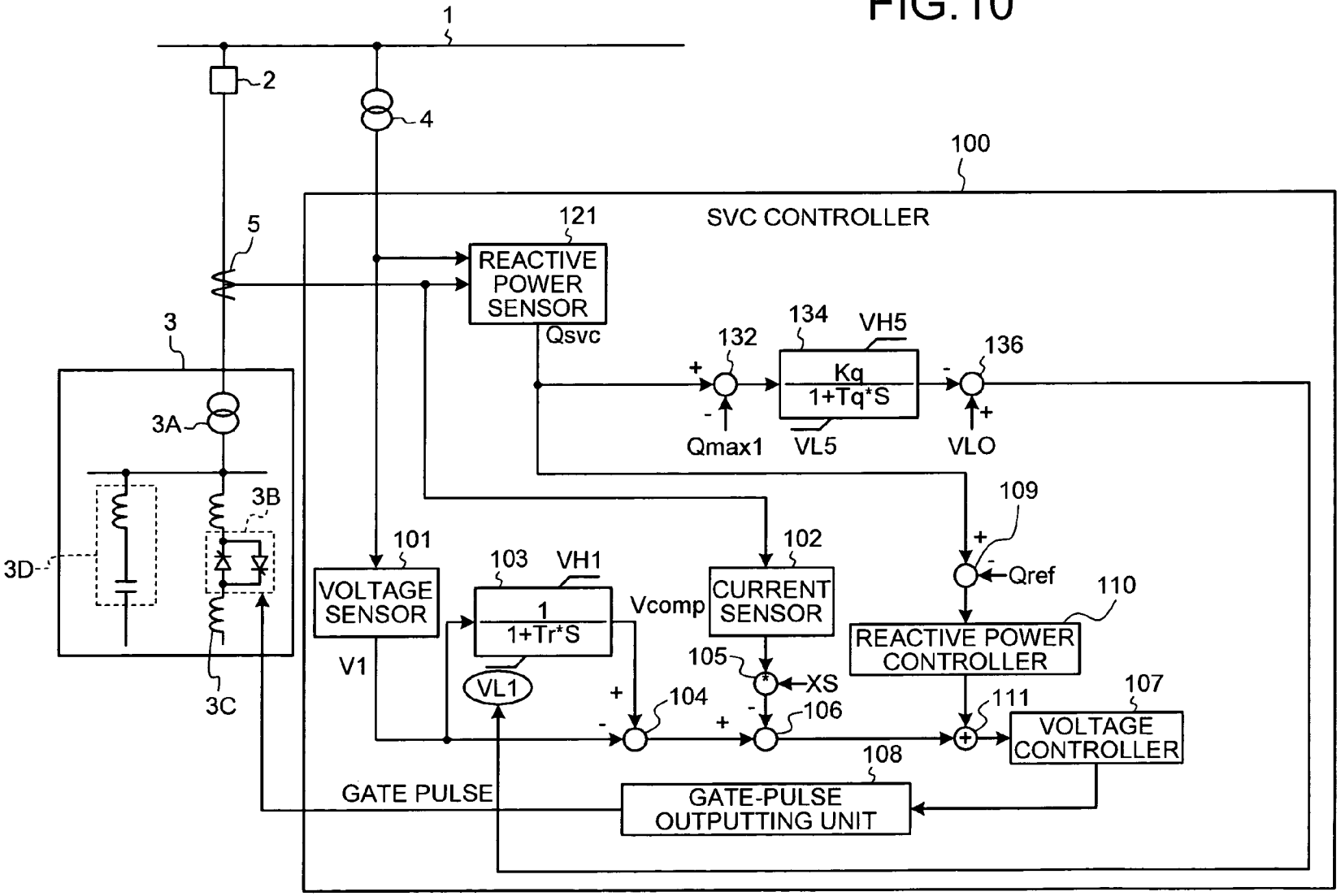
FIG. 10 is a schematic diagram of a reactive power compensator including a reactive power control device according to a fourth embodiment of the present invention.

FIG. 10 is a schematic diagram of a reactive power compensator including a reactive power control device according to a fourth embodiment of the present invention. The reactive power compensator shown in FIG. 10 is related to a control of the lower limit value (VL1) of the primary delay-control block 103 with a limiter. In the third embodiment, the control was performed based on the output of the voltage sensor 120 that is a detection output of the voltage of the bus 12. However, in the fourth embodiment, the control is performed based on an output of the reactive power sensor 121. To form such a control system, the reactive power compensator according to the fourth embodiment includes a differentiator 132. The differentiator 132 outputs a differential between an output of the reactive power sensor 121 and an upper limit value (Qmax1) of the SVC output control range. The reactive power compensator according to the fourth embodiment also includes a primary delay-control block 134 with a limiter. The primary delay-control block 134 with a limiter receives the output of the differentiator 132 and produces the predetermined control signals (voltage signals) following with a predetermined time delay characteristic. The reactive power compensator also includes a differentiator 136 that receives the output of the primary delay-control block 134 with a limiter, and outputs a differential with respect to the predetermined voltage (VL0). In the configuration, the differentiator 132, the primary delay-control block 134 with a limiter, and the differentiator 136 form an output restriction value changing unit (secondary output-restriction-value changing unit). The output restriction value changing unit changes the output restriction value of the primary delay-control block 103 with a limiter that forms the comparison-voltage producing unit. The other configurations are similar to those shown in FIG. 8, and the same elements are denoted by the same reference numerals and the description thereof will be omitted.

Figure 11:
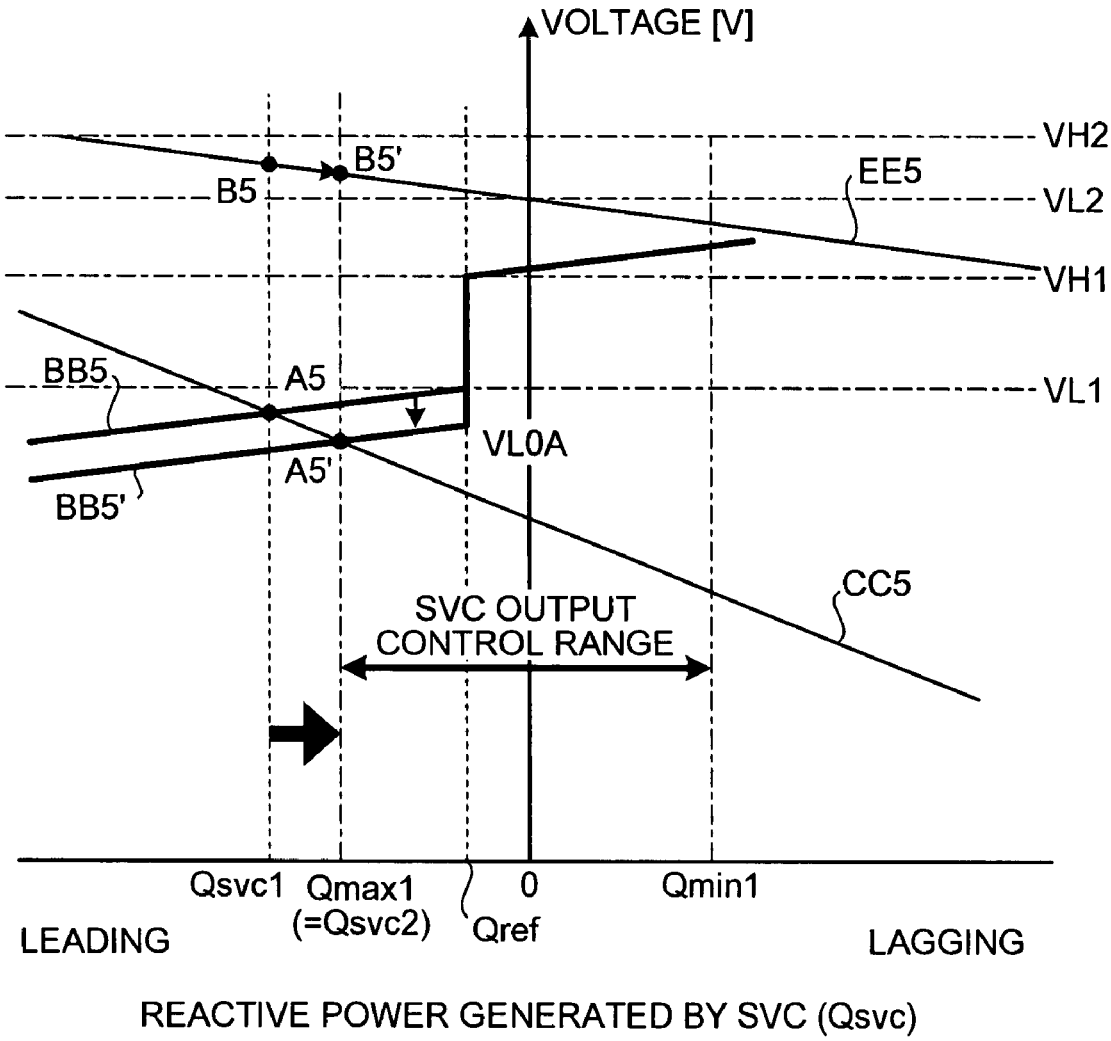
FIG. 11 is a schematic diagram for explaining an operation of the reactive power compensator shown in FIG. 10.

The operation of the reactive power compensator according to the fourth embodiment will now be described with reference to FIGS. 10 and 11. FIG. 11 is a schematic diagram for explaining the operation of the reactive power compensator according to the fourth embodiment.

As shown in FIG. 11, the operating point of the bus 1 is on a straight line of Qsvc=Qsvc1, and controlled by an intersection point (operating point A5) of a static characteristic line BB5 of the bus 1 and a system characteristic line CC5. The operating point of the bus 12 is controlled by an intersection point (operating point B5) of a system characteristic line EE5 of the bus 12 and the straight line of Qsvc=Qsvc 1. At this state, when the control signals that control the lower limit value (VL1) of the primary delay-control block 103 with a limiter are input, the following control is performed:

(1) At an initial state when the operating point on the system characteristics of the bus 1 is at A5, it is Qsvc1>Qmax, and the output of the SVC 3 exceeds the upper limit value (Qmax1) of the SVC output control range. However, because it has reached VL1 that is the control range of the output voltage of the bus 1, the output of the SVC 3 cannot be adjusted (in the previous configurations, because the control of including the output voltage V1 of the bus 1 within the control range was given preference).

(2) As a result, the operating point on the system characteristics of the bus 1 maintains the state of A5, and the operating point on the system characteristics of the bus 12 maintains the state of B5. At this state, because it is Qsvc1>Qmax1 as the above, the control to increase the voltage of the bus 12 cannot be performed, even if the voltage of the bus 12 at the remote place drops sharply and falls below the lower limit value.

(3) Consequently, to bring the output of the SVC 3 to fall within the SVC output control range, a control to reduce the lower limit value (VL1) of the primary delay-control block 103 with a limiter is performed, based on the output of the differentiator 136. In other words, a new lower limit value (VL0A) is set by shifting the lower limit value (VL1) at the primary delay-control block 124 with a limiter to the lower direction, with the output of the differentiator 136. By this control, the operating point A5 on the system characteristic line CC5 of the bus 1 moves to A5' (static characteristic line BB5"). The operating point B5 on the system characteristic line EE5 moves to B5'.

(4) At this state, because the output of the SVC 3 falls within the SVC output control range, the control to increase the voltage of the bus 12 can be performed, when the voltage of the bus 12 drops sharply and falls below the lower limit value.

An example is explained above in which the output (leading output side is positive) of the SVC 3 exceeds the upper limit value of the SVC output control range was explained. However, similar operation can be performed, when the output of the SVC 3 falls below the lower limit value of the SVC output control range. This is enabled by forming a control system that increases the upper limit value (VH1) of the primary delay-control block 103 with a limiter, based on the spirit and scope of the reactive power compensator according to the fourth embodiment.

As described above, in the reactive power compensator according to the fourth embodiment, when the output of the SVC 3 deviates from the SVC output control range, a state of canceling the control by the SVC 3 can be avoided, by adjusting the lower limit value (VL1) or the upper limit value (VH1) of the primary delay-control block 103 with a limiter. Therefore, when an electrical transmission facility at a remote place does not have phase modifying equipment, or even if it does have phase modifying equipment, when the control elements of the phase modifying equipment are used up, a state to preferentially control the voltage at the electrical transmission facility at the remote place can be maintained.

Figure 12:
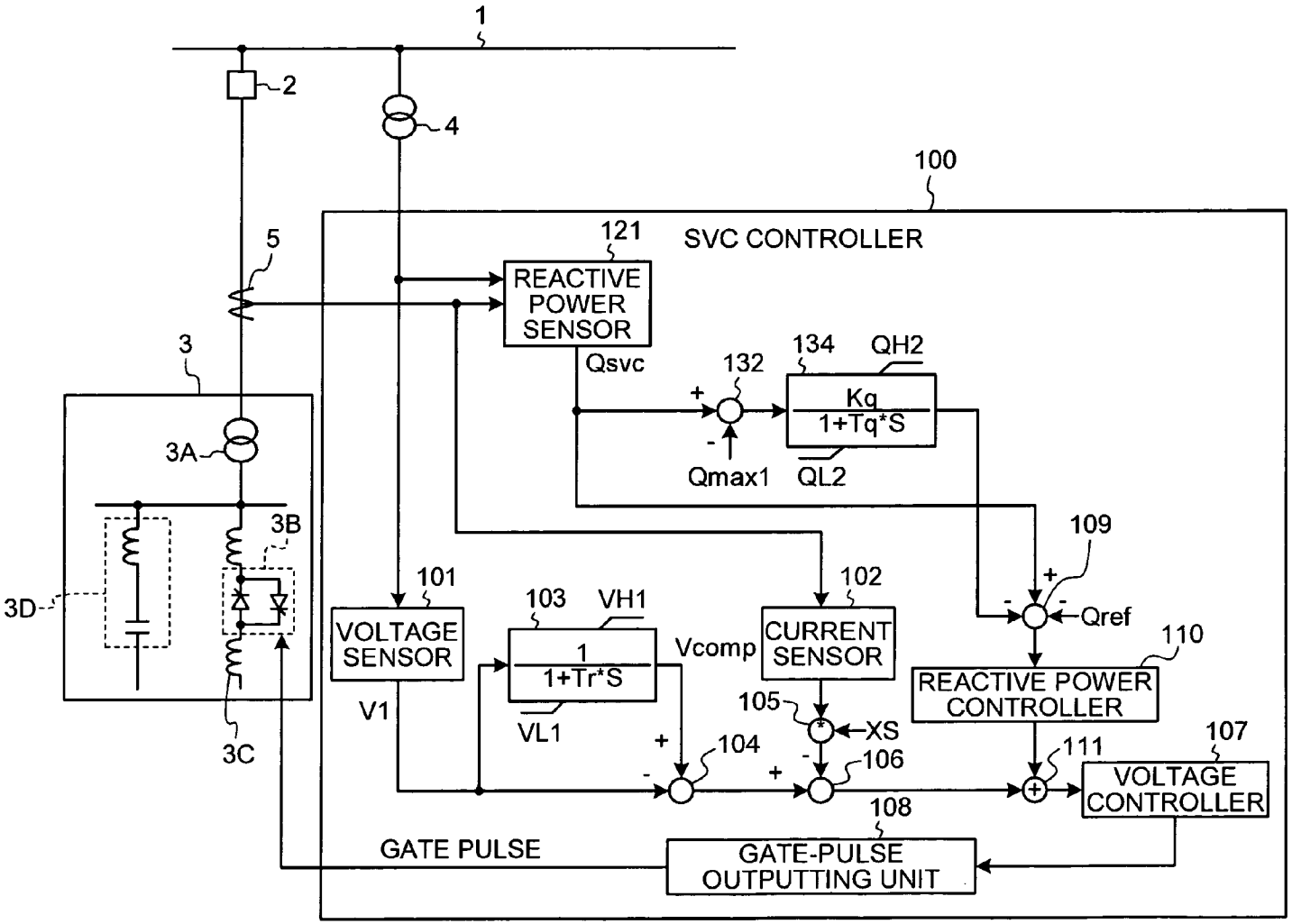
FIG. 12 is a schematic diagram of a reactive power compensator including a reactive power control device according to a fifth embodiment of the present invention.

FIG. 12 is a schematic diagram of a reactive power compensator including a reactive power control device according to a fifth embodiment of the present invention. The reactive power compensator according to the fourth embodiment includes the control system that controls the lower limit value (VL1) of the primary delay-control block 103 with a limiter. However, the reactive power compensator according to the fifth embodiment adjusts the initial value (Qref) of the reactive power Qsvc that is output by the SVC 3. This is enabled by using a similar control system to that of the fourth embodiment. Therefore, the reactive power compensator according to the fifth embodiment includes the differentiator 132 and the primary delay-control block 134 with a limiter that were included in the fourth embodiment. Also, the reactive power compensator according to the fifth embodiment includes a control system that receives the control output of the primary delay-control block 134 with a limiter to the differentiator 109. In the configuration, the differentiator 132 and the primary delay-control block 134 with a limiter form the reactive-power initial-value changing signal producing unit (secondary reactive-power initial-value changing signal producing unit). The reactive-power initial-value changing signal producing unit produces the control signals to change the reactive power initial value. The other configurations are similar to those shown in FIG. 10, and the same elements are denoted by the same reference numerals, and the description thereof will be omitted.

Figure 13:
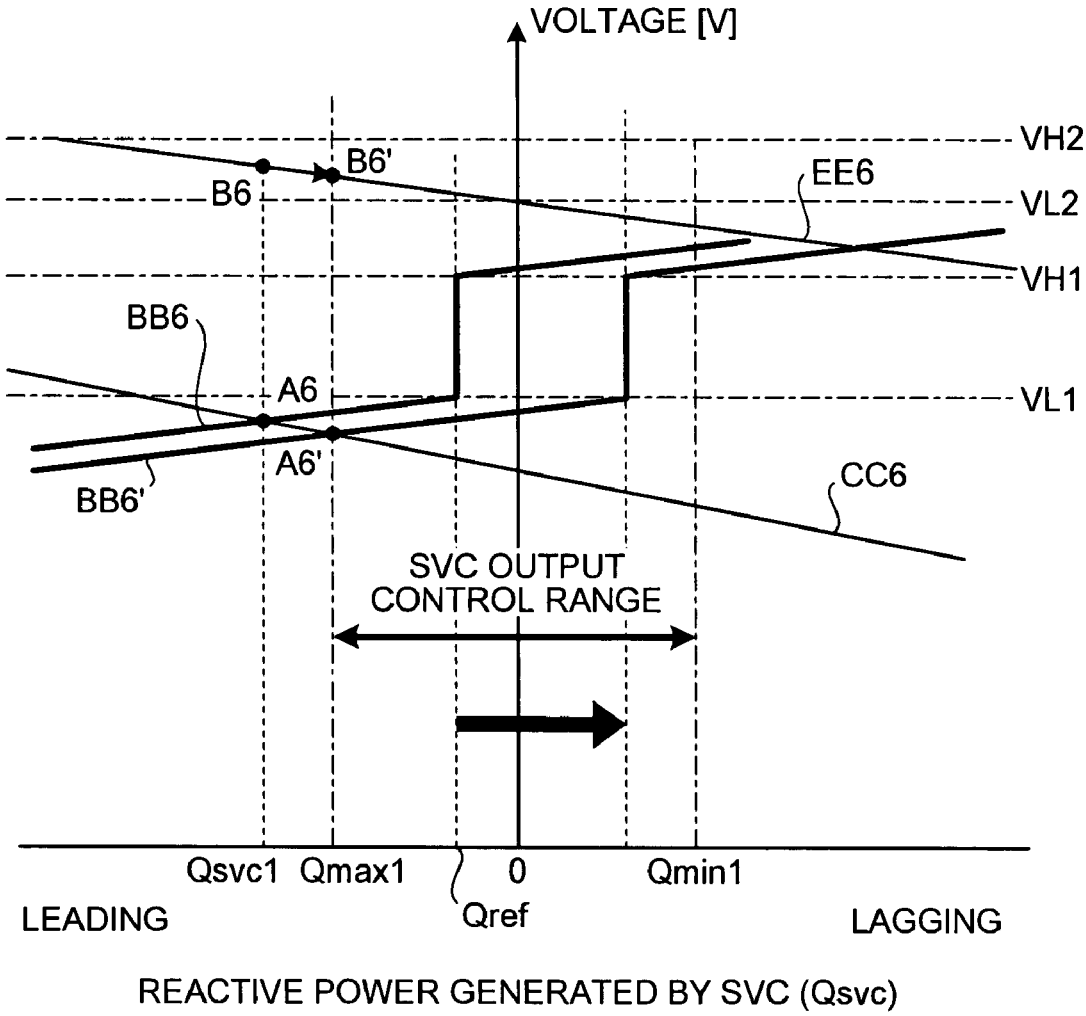
FIG. 13 is a schematic diagram for explaining an operation of the reactive power compensator according to the fifth embodiment.

The operation of the reactive power compensator according to the fifth embodiment will now be described with reference to FIGS. 12 and 13. FIG. 13 is a schematic diagram for explaining the operation of the reactive power compensator according to the fifth embodiment.

As shown in FIG. 13, the operating point of the bus 1 is on the straight line of Qsvc=Qsvc1, and controlled by an intersection point (operating point A6) of a static characteristic line BB6 of the bus 1 and a system characteristic line CC6. The operating point of the bus 12 is controlled by an intersection point (operating point B6) of a system characteristic line EE6 of the bus 12 and the straight line of Qsvc=Qsvc1. At this state, when the output of the primary delay-control block 134 with a limiter is input to the differentiator 109, the following control is performed:

(1) At an initial state when the operating point on the system characteristics of the bus 1 is at A6, it is Qsvc1>Qmax1. Although the output of the SVC 3 exceeds the upper limit value (Qmax1) of the SVC output control range, it has reached VL1 that is the control range of the output voltage of the bus 1. Therefore, as in the fourth embodiment, the output of the SVC 3 cannot be adjusted.

(2) As a result, the operating point on the system characteristics of the bus 1 maintains the state of A6, and the operating point on the system characteristics of the bus 12 maintains the state of B6. At this state, because it is Qsvc1>Qmax1 as the above, the control to increase the voltage of the bus 12 cannot be performed, even if the voltage of the bus 12 at the remote place drops sharply and falls below the lower limit value.

(3) Consequently, to bring the output of the SVC 3 to fall within the SVC output control range, a control to change (shift to the lagging phase side) the initial value (Qref) of Qsvc is performed, based on the output of the primary delay-control block 134 with a limiter. By this control, the operating point A6 on the system characteristic line CC5 of the bus 1 moves to A6' (static characteristic line BB6'). The operating point B6 on the system characteristic line EE6 of the bus 12 moves to B6'.

(4) At this state, because the output of the SVC 3 falls within the SVC output control range, the control to increase the voltage of the bus 12 can be performed, when the voltage of the bus 12 drops sharply and falls below the lower limit value.

An example is explained above in which the output of the SVC 3 (leading output side is positive) exceeds the upper limit value of the SVC output control range was explained. However, a similar operation can be performed, when the output of the SVC 3 drops below the lower limit value of the SVC output control range. This is enabled by forming a system control that shifts the initial value (Qref) of the output of the SVC 3 to the leading phase side, irrespective of the control range of the output voltage of the bus 1, based on the spirit and scope of the reactive power compensator according to the fifth embodiment.

As described above, in the reactive power compensator according to the fifth embodiment, the state of canceling the control by the SVC 3 can be avoided, when the output of the SVC 3 deviates from the SVC output control range. This is enabled by performing a control to shift the initial value of the output of the SVC 3 to the lagging phase side or the leading phase side, irrespective of the control range of the output voltage of the bus 1. Therefore, when an electrical transmission facility at a remote place does not have phase modifying equipment, or even if it does have phase modifying equipment, when the control elements of the phase modifying equipment are used up, it is possible to maintain the state to preferentially control the voltage at the electrical transmission facility at the remote place.

In the first through fifth embodiments, it was explained that the bus 1 is the controlled bus disposed near the SVC 3, and the bus 12 is the controlled bus disposed apart from the SVC 3 at the remote place. However, the SVC 3 does not necessarily be disposed near the bus 1. An essential point is that the bus 1 and the bus 12 are in a relationship that is arranged apart. Viewed from the SVC 3, as long as the bus 1 can be handled as the controlled bus that is disposed nearby, and the bus 12 can be handled as the controlled bus that is at the remote place, any installation mode is acceptable.

In the reactive power compensator according to some aspects of the present invention, the reactive power adjusting unit can control a second controlled voltage so as to fall within a predetermined fixed range. This is enabled by adjusting the initial value of the reactive power that is output by the static var compensator, when the second controlled voltage is deviated from the predetermined range. The second controlled voltage is the bus voltage of a second controlled bus that is laid at a position apart from a first controlled bus laid at a position near the static var compensator. Therefore, the reactive power compensator offers a beneficial advantage, when an electrical transmission facility at a remote place does not have phase modifying equipment, or even if it does have phase modifying equipment, when the control elements of the phase modifying equipment are used up, the voltage at the electrical transmission facility at the remote place can be preferentially controlled.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A reactive power compensator having a static var compensator that generates reactive power corresponding to a voltage fluctuation of a connection bus, wherein the reactive power compensator suppresses voltage fluctuation of a first controlled bus laid near the static var compensator and suppresses voltage fluctuation of a second controlled bus laid at a distance from the static var compensator, the reactive power compensator comprising:

a comparison-voltage producing unit that produces a comparison voltage following a first controlled voltage, which is a bus voltage of the first controlled bus, with a predetermined time delay characteristic and restricted to a predetermined range;

a fluctuating-voltage producing unit that produces a fluctuating voltage being a differential output between the comparison voltage and the first controlled voltage;

a reactive power controller that controls the reactive power generated by the static var compensator to be controlled corresponding to the fluctuating voltage with a time characteristic faster than the time delay characteristic of the comparison voltage;

a reactive-power initial-value changing signal producing unit that produces a reactive-power initial-value changing signal that is a signal indicative of whether a second controlled voltage, which is a bus voltage of the second controlled bus, has deviated from a predetermined range follow with a predetermined time delay characteristic; and a reactive power adjusting unit that sets the reactive power produced by the static var compensator to a predetermined value, based on the reactive power produced by the static var compensator, the comparison voltage produced by the comparison-voltage producing unit, and a predetermined initial value, the reactive power adjusting unit controlling the second controlled voltage so as to fall within the predetermined range when the second controlled voltage has deviated from the predetermined range.

2. The reactive power compensator according to claim 1, wherein the reactive power adjusting unit temporarily lifts a restriction against an upper limit value or a lower limit value set as an output control range of the static var compensator, and gives a preference to a control that the second controlled voltage falls within the predetermined range.

3. A reactive power compensator having a static var compensator that generates reactive power corresponding to a voltage fluctuation of a connection bus, wherein the reactive power compensator suppresses voltage fluctuation of a first controlled bus laid near the static var compensator and suppresses voltage fluctuation of a second controlled bus laid at a distance from the static var compensator, the reactive power compensator comprising:

a comparison-voltage producing unit that produces a comparison voltage following a first controlled voltage, which is a bus voltage of the first controlled bus, with a predetermined time delay characteristic and restricted to a predetermined range;

a fluctuating-voltage producing unit that produces a fluctuating voltage being a differential output between the comparison voltage and the first controlled voltage;

a reactive power controller that controls the reactive power generated by the static var compensator to be controlled corresponding to the fluctuating voltage with a time characteristic faster than the time delay characteristic of the comparison voltage;

an output restriction value changing unit that changes an output restriction value of the comparison voltage produced by the comparison-voltage producing unit based on a second controlled voltage, which is a bus voltage of the second controlled bus; and a reactive power adjusting unit that sets the reactive power produced by the static var compensator to a predetermined value, based on the reactive power produced by the static var compensator and a predetermined initial value, the reactive power adjusting unit controlling the second controlled voltage so as to fall within the predetermined range when the second controlled voltage has deviated from the predetermined range.

4. A reactive power compensator having a static var compensator that generates reactive power corresponding to a voltage fluctuation of a connection bus, wherein the reactive power compensator suppresses voltage fluctuation of a first controlled bus laid near the static var compensator and suppresses voltage fluctuation of a second controlled bus laid at a distance from the static var compensator, the reactive power compensator comprising:

a comparison-voltage producing unit that produces a comparison voltage following a first controlled voltage, which is a bus voltage of the first controlled bus, with a predetermined time delay characteristic and restricted to a predetermined range;

a fluctuating-voltage producing unit that produces a fluctuating voltage being a differential output between the comparison voltage and the first controlled voltage;

a reactive power controller that controls the reactive power generated by the static var compensator to be controlled corresponding to the fluctuating voltage with a time characteristic faster than the time delay characteristic of the comparison voltage;

an output restriction value changing unit that changes an output restriction value of the comparison voltage produced by the comparison-voltage producing unit based on the reactive power produced by the static var compensator; and a reactive power adjusting unit that sets the reactive power produced by the static var compensator to a predetermined value, based on the reactive power produced by the static var compensator and a predetermined initial value, the reactive power adjusting unit controlling the reactive power so as to fall within the predetermined range, when the reactive power produced by the static var compensator has deviated from the predetermined range.

5. A reactive power compensator having a static var compensator that generates reactive power corresponding to a voltage fluctuation of a connection bus, wherein the reactive power compensator suppresses voltage fluctuation of a first controlled bus laid near the static var compensator and suppresses voltage fluctuation of a second controlled bus laid at a distance from the static var compensator, the reactive power compensator comprising:

a comparison-voltage producing unit that produces a comparison voltage following a first controlled voltage, which is a bus voltage of the first controlled bus, with a predetermined time delay characteristic and restricted to a predetermined range;

a fluctuating-voltage producing unit that produces a fluctuating voltage being a differential output between the comparison voltage and the first controlled voltage;

a reactive power controller that controls the reactive power generated by the static var compensator to be controlled corresponding to the fluctuating voltage with a time characteristic faster than the time delay characteristic of the comparison voltage;

a reactive-power initial-value changing signal producing unit that produces a signal for changing an initial value of the reactive power as a reactive-power initial-value changing signal based on the reactive power produced by the static var compensator; and a reactive power adjusting unit that sets the reactive power produced by the static var compensator to a predetermined value, based on the reactive power produced by the static var compensator and a predetermined initial value, the reactive power adjusting unit controlling the reactive power so as to fall within the predetermined range, when the reactive power produced by the static var compensator has deviated from the predetermined range.

6. A reactive power control device that controls a static var compensator generating reactive power corresponding to a voltage fluctuation of a connection bus, wherein the reactive power compensator suppresses voltage fluctuation of a first controlled bus laid near the static var compensator and suppresses voltage fluctuation of a second controlled bus laid at a distance from the static var compensator, the reactive power compensator comprising:

a comparison-voltage producing unit that produces a comparison voltage following a first controlled voltage, which is a bus voltage of the first controlled bus, with a predetermined time delay characteristic and restricted to a predetermined range;

a fluctuating-voltage producing unit that produces a fluctuating voltage being a differential output between the comparison voltage and the first controlled voltage;

a reactive power controller that controls the reactive power generated by the static var compensator to be controlled corresponding to the fluctuating voltage by a time characteristic faster than the time delay characteristic of the comparison voltage;

a reactive-power initial-value changing signal producing unit that produces a reactive-power initial-value changing signal that is a signal indicative of weather a second controlled voltage, which is a bus voltage of the second controlled bus, has deviated from a predetermined range follow with a predetermined time delay characteristic; and a reactive power adjusting unit that sets the reactive power produced by the static var compensator to a predetermined value, based on the reactive power produced by the static var compensator, the comparison voltage produced by the comparison-voltage producing unit, and a predetermined initial value, the reactive power adjusting unit controlling the second controlled voltage so as to fall within the predetermined range, when the second controlled voltage has deviated from the predetermined range.

7. The reactive power control device according to claim 6, wherein the reactive power adjusting unit temporarily lifts a restriction against an upper limit value or a lower limit value set as an output control range of the static var compensator, and gives a preference to a control that the second controlled voltage falls within the predetermined range.

8. A reactive power control device that controls a static var compensator that generates reactive power corresponding to a voltage fluctuation of a connection bus, wherein the reactive power compensator suppresses voltage fluctuation of a first controlled bus laid near the static var compensator and suppresses voltage fluctuation of a second controlled bus laid at a distance from the static var compensator, the reactive power control device comprising:

a comparison-voltage producing unit that produces a comparison voltage following a first controlled voltage, which is a bus voltage of the first controlled bus, with a predetermined time delay characteristic and restricted to a predetermined range;

a fluctuating-voltage producing unit that produces a fluctuating voltage being a differential output between the comparison voltage and the first controlled voltage;

a reactive power controller that controls the reactive power generated by the static var compensator to be controlled corresponding to the fluctuating voltage by a time characteristic faster than the time delay characteristic of the comparison voltage;

an output restriction value changing unit that changes an output restriction value of the comparison voltage produced by the comparison-voltage producing unit based on a second controlled voltage, which is a bus voltage of the second controlled bus; and a reactive power adjusting unit that sets the reactive power produced by the static var compensator to a predetermined value, based on the reactive power produced by the static var compensator and a predetermined initial value, the reactive power adjusting unit controlling the second controlled voltage so as to fall within the predetermined range, when the second controlled voltage has deviated from the predetermined range.

9. A reactive power control device that controls a static var compensator that generates reactive power corresponding to a voltage fluctuation of a connection bus, wherein the reactive power compensator suppresses voltage fluctuation of a first controlled bus laid near the static var compensator and suppresses voltage fluctuation of a second controlled bus laid at a distance from the static var compensator, the reactive power control device comprising:

a comparison-voltage producing unit that produces a comparison voltage following a first controlled voltage, which is a bus voltage of the first controlled bus, with a predetermined time delay characteristic and restricted to a predetermined range;

a fluctuating-voltage producing unit that produces a fluctuating voltage being a differential output between the comparison voltage and the first controlled voltage;

a reactive power controller that controls the reactive power generated by the static var compensator to be controlled corresponding to the fluctuating voltage by a time characteristic faster than the time delay characteristic of the comparison voltage;

an output restriction value changing unit that changes an output restriction value of the comparison voltage produced by the comparison-voltage producing unit based on the reactive power produced by the static var compensator; and a reactive power adjusting unit that sets the reactive power produced by the static var compensator to a predetermined value, based on the reactive power produced by the static var compensator and a predetermined initial value, the reactive power adjusting unit controlling the reactive power so as to fall within the predetermined range, when the reactive power produced by the static var compensator has deviated from the predetermined range.

10. A reactive power control device that controls a static var compensator that generates reactive power corresponding to a voltage fluctuation of a connection bus, wherein the reactive power compensator suppresses voltage fluctuation of a first controlled bus laid near the static var compensator and suppresses voltage fluctuation of a second controlled bus laid at a distance from the static var compensator, the reactive power control device comprising:

a comparison-voltage producing unit that produces a comparison voltage following a first controlled voltage, which is a bus voltage of the first controlled bus, with a predetermined time delay characteristic and restricted to a predetermined range;

a fluctuating-voltage producing unit that produces a fluctuating voltage being a differential output between the comparison voltage and the first controlled voltage;

a reactive power controller that controls the reactive power generated by the static var compensator to be controlled corresponding to the fluctuating voltage by a time characteristic faster than the time delay characteristic of the comparison voltage;

a reactive-power initial-value changing signal producing unit that produces a signal for changing an initial value of the reactive power as a reactive-power initial-value changing signal based on the reactive power produced by the static var compensator; and a reactive power adjusting unit that sets the reactive power produced by the static var compensator to a predetermined value, based on the reactive power produced by the static var compensator and a predetermined initial value, the reactive power adjusting unit controlling the reactive power so as to fall within the predetermined range, when the reactive power produced by the static var compensator has deviated from the predetermined range.

* * * * *